US005209027A

United States Patent [19]

Ishida et al.

[11] Patent Number: 5,209,027

[45] Date of Patent: May 11, 1993

[54] POLISHING OF THE REAR SURFACE OF A STAMPER FOR OPTICAL DISK REPRODUCTION

[75] Inventors: Toshihiko Ishida, Komoro; Tetuji Takamizawa, Usuda; Hiroyuki Arioka, Saku, all of Japan

[73] Assignee: TDK Corporation, Tokyo, Japan

[21] Appl. No.: 819,067

[22] Filed: Jan. 10, 1992

Related U.S. Application Data

[63] Continuation-in-part of Ser. No. 596,028, Oct. 11, 1990, abandoned.

[30] Foreign Application Priority Data

Oct. 13, 1989 [JP] Japan ..... 1-267692

[51] Int. Cl.[5] ..... B24B 1/00

[52] U.S. Cl. ..... 51/283 R; 51/328; 51/141

[58] Field of Search ..... 51/283 R, 328, 135 R, 51/141, 145 R

[56] References Cited

U.S. PATENT DOCUMENTS 2,977,725 4/1961 Simendinger ..... 51/141
4,930,259 6/1990 Kobylenski et al. ..... 51/145 R

FOREIGN PATENT DOCUMENTS 196962 11/1983 Japan .

*Primary Examiner*—M. Rachuba
*Attorney, Agent, or Firm*—Oblon, Spivak, McClelland, Maier & Neustadt

[57] ABSTRACT

The rear surface of a stamper for use in the manufacture of optical disks should be polished to precision. A length of abrasive tape is fed across the stamper in pressure contact with the rear surface of the stamper through a pressure roller having a rubber sleeve with a hardness of up to 80 degrees as measured according to ASTM D 2240 type A while the stamper is rotating.

5 Claims, 1 Drawing Sheet

POLISHING OF THE REAR SURFACE OF A STAMPER FOR OPTICAL DISK REPRODUCTION

This application is a Continuation-in-Part Application of our copending U.S. Ser. No. 07/596,028 filed Oct. 11, 1990 now abandoned.

This invention relates to a method for polishing the rear surface of a stamper for use in the manufacture of optical disks including optical recording disks, magnetooptic recording disks, and optical read only disks.

BACKGROUND OF THE INVENTION

In optical recording disks, magnetooptic recording disks, and optical read only disks, various grooves and pits are formed as recording spots and for tracking and other addressing purposes. Such optical recording disks, magnetooptic recording disks, and optical read only disks are manufactured by either an injection method in which grooves and pits are formed at the same time as injection molding of a substrate or a so-called 2P method in which a photo polymer layer is formed on a substrate and grooves and pits are formed in the photo polymer layer. In either method, disks are manufactured in a reproducible manner using a stamper for duplicating the grooves and pits.

The stamper is produced by the following sequence of steps:

(1) abrading one surface of a substrate, for example, a disk-shaped glass plate which forms an original for stamper production into a flat surface, (2) scrubbing the abraded surface, (3) cleaning the abraded surface after scrubbing, (4) forming a photoresist layer on the abraded surface, (5) exposing the photoresist layer to light, for example, laser beams in a mother pattern corresponding to a stamper pattern for duplicating grooves and/or pits in optical disks, (6) developing the photoresist layer after exposure, to thereby form the mother or original pattern, (7) forming an underlying metal layer on the mother pattern, (8) electroforming an overlying metal layer on the underlying layer, (9) removing the metal film of overlying and underlying metal layers from the glass plate, the metal film having a surface for duplicating the mother pattern and a rear surface,

(10) shaping the outer and inner peripheries of the metal film,

(11) polishing the rear surface of the metal film into a flat surface, and

(12) other necessary processing.

Since the performance of optical disk depends on the flatness accuracy of the surface in which grooves and/or pits (grooves being often used as a representative term, hereinafter) are formed, it is a critical factor in the manufacture of optical disks to increase the flatness of the front surface of a glass plate which is a substrate for the production of a stamper and the rear surface of the stamper.

The flatness of the rear surface of a stamper directly governs the depth and width of grooves in the resulting optical disks because the stamper is set in place within a mold in the injection molding method or the stamper is attached to the pressing surface of a stamping machine in the 2P method. Therefore, attempts have been made to increase the flatness of the rear surface of a stamper by polishing or the like. The attempts for polishing the stamper rear surface include the use of free abrasive grains and the use of abrasive tape. The former is known as a free abrasive method. The latter method laps the rear surface of the stamper by rotating the stamper while pressing abrasive tape against the rear surface of the stamper through a pressure member such as a rubber roller as disclosed in Japanese Patent Application Kokai No. 196962/1983.

In optical disks, information is reproduced by directing reproducing light, typically laser light from a reproducing head to the information recording or carrying surface. If the information carrying surface has irregularities, the reproducing head is accelerated upward or downward for focusing. The acceleration, known as dynamic axial runout acceleration, is increased as the disk revolution is increased. For example, compact disks (CD) which are typical optical read only disks are rotated about 600 r.p.m. at the maximum during operation, whereas information recording optical disks like magnetooptic recording disks which require quick access and data transfer are operated at as high revolution as 1,800 to 3,600 r.p.m. The dynamic axial runout acceleration at a location spaced 55 mm radially from the disk center during operation at 1,800 r.p.m., for example, is about 8 times the CD operation. It is desired to minimize irregularities on the disk substrate surface particularly in information recording optical disks adapted for high speed rotation. To this end, the stamper rear surface should be polished to a more precise accuracy.

SUMMARY OF THE INVENTION

An object of the present invention is to provide a method for polishing the rear surface of a stamper for use in the manufacture of optical disks, the stamper being a metal film separated from an original photoresist layer.

To attain the above and other objects, the present invention provides a method for polishing the rear surface of a stamper for use in the manufacture of optical disks, comprising the step of feeding a length of abrasive tape across the stamper in pressure contact with the rear surface of the stamper through a pressure roller while the stamper is rotating. According to the present invention, the pressure roller includes a surface layer formed of a rubber having a hardness of up to 80 degrees as measured according to ASTM D 2240 type A.

Preferably, the surface layer has a radial thickness of at least 5 mm. The pressure roller is pressed again the stamper under a pressure of 0.5 to 3.0 kgf/cm$^2$, the abrasive tape is fed at a speed of 1.0 to 4.0 mm/sec., and the stamper is rotated at 100 to 400 r.p.m.

Since the pressure roller for pressing the abrasive tape against the rear surface of the stamper has a surface layer of rubber having an appropriate hardness, the response of the pressure roller to vibrations of the polishing machine is minimized to ensure that the stamper rear surface is uniformly polished into a smooth and flat surface. Then optical disks which are manufactured using the stamper of the invention produce a minimal dynamic axial runout acceleration, for example, up to 10 m/sec$^2$ at 1,800 r.p.m. and in some cases, up to 5 m/sec$^2$ at 1,800 r.p.m.

It is to be noted that Japanese Patent Application Kokai No. 196962/1983 discloses a rubber roller for pressing abrasive tape against a stamper for use in the manufacture of gramophonic records and video disks. This publication refers nowhere to the rubber hardness and information recording optical disks requiring high speed rotation.

BRIEF DESCRIPTION OF THE DRAWINGS

The only figure, FIG. 1 schematically illustrates an arrangement for polishing the rear surface of a stamper according to the present invention.

DESCRIPTION OF THE PREFERRED EMBODIMENTS

Figure 1:
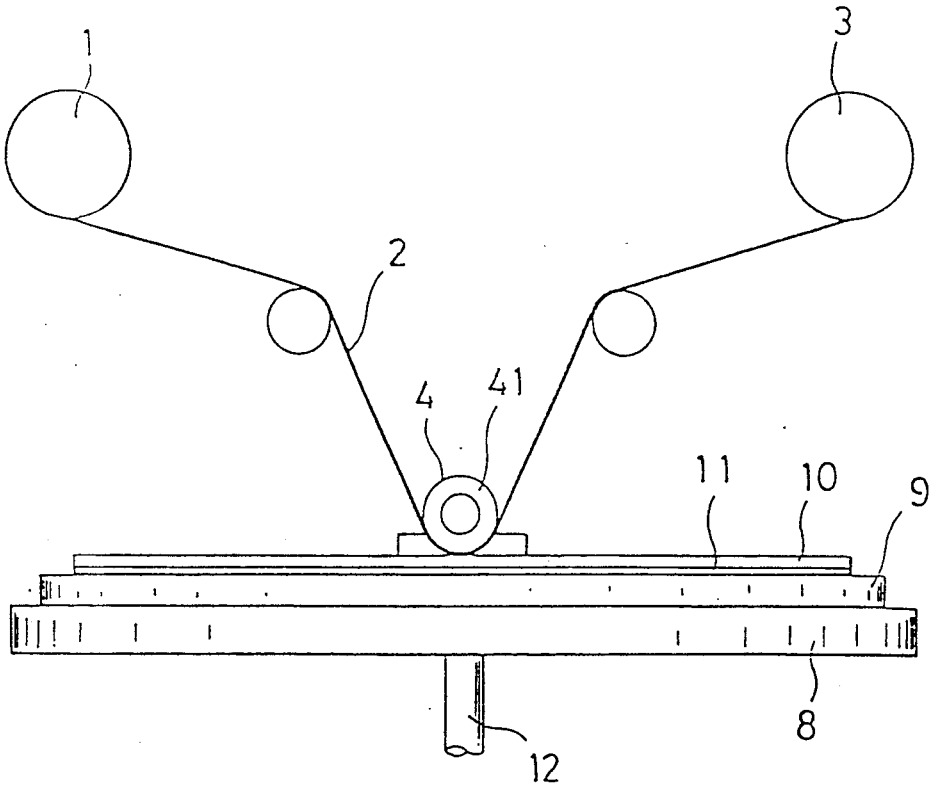

The polishing apparatus shown in FIG. 1 includes a tape feed arrangement having a feed reel 1 having a length of abrasive tape 2 wound thereon and a take-up roll 3 which is rotated by drive means (not shown). A length of abrasive tape 2 is extended from the feed reel 1 to the take-up roll 3 along a predetermined path via guide rollers and a pressure roller 4. The pressure roller 4 is located so as to bring the abrasive tape 2 in pressure contact with the rear surface of a stamper 10 on passage of the abrasive tape 2 along its path. The pressure roller 4 is a free rotating roller which is biased toward the stamper 10 by biasing means (not shown, for example, a spring member) so that the pressure roller 4 is forced against the stamper via the abrasive tape 2.

The stamper 10 is, most often, a circular metal film such as an electroformed nickel film, typically having a diameter of about 80 mm to about 300 mm and a thickness of about 0.2 mm to about 0.5 mm. The stamper 10 has a pair of major surfaces, a duplicating surface (lower surface in the figure) and a rear surface (upper surface in the figure).

The apparatus further includes attachment means for fixedly securing the stamper 10 for rotation. In the illustrated embodiment, the stamper 10 is bonded to a glass support 9 rested on the turntable 8 through a double adhesive tape 11. The stamper 10 is rotatable with the turntable 8 which is coupled to drive means (not shown) through a rotating shaft 12.

The apparatus operates as follows for polishing the rear surface of the stamper 10. While rotating the turntable 8 and stamper 10 therewith, the abrasive tape 2 is passed across the pressure roller 4 from the feed reel 1 to the take-up reel 3. At the same time, the tape feed arrangement including feed reel 1, abrasive tape 2, take-up reel 3, and pressure roller 4 is reciprocated radially of the stamper 10 by drive means (not shown). The pressure roller 4 is rotated with the feed of the abrasive tape 2. It will be understood that fluid such as water, detergent, or lubricant is passed over the stamper rear surface during polishing operation in order to remove polishing debris and to suppress temperature increase.

According to the invention, the above-illustrated polishing apparatus for polishing the stamper at its rear surface uses the pressure roller 4 having a surface layer 41 formed of rubber. That is, the pressure roller 4 consists of a rod covered on the outer surface with the rubber layer 41. The rubber should have a hardness of up to 80 degrees, preferably from 20 to 80 degrees, as measured according to ASTM D 2240 type A. The rubber layer has a function to damp vibrations of a motor for driving the turntable 8 and stamper 10 therewith which adversely affect the contact between the stamper 10 and the abrasive tape 2. Harder rubber in excess of 80 degrees is insufficient in damping function, failing to assist in uniform polishing. The lower limit of hardness of the rubber used is not particularly determined, but in many cases, a hardness of less than 20 degrees is undesirable because the polishing rate is substantially reduced. The rubber layer 41 on the pressure roller 4 preferably has a radial thickness of at least 5 mm, more preferably at least 8 mm.

It is to be noted that the center rod of the pressure roller 4 is usually formed of rigid material such as metal.

The rubber material of which the surface layer of the pressure roller 4 is formed is not particularly limited insofar as it possesses a hardness in the above-defined range. Urethane rubber is often used for ease of working.

The diameter and axial length of the pressure roller 4 are not particularly limited and may be determined depending on the size of a stamper to be polished. In many cases, the roller 4 has a diameter of about 40 mm to about 60 mm and an axial length of about 20 mm to about 100 mm. Since the portion of the rear surface of a stamper to be polished is typically annular, the axial length of pressure roller 4 is preferably about 50 to 100% of the radial width of the annular portion to be polished.

Preferably, the pressure roller 4 is pressed against the abrasive tape and hence the stamper 10 under a pressure of 0.5 to 3.0 kgf/cm$^2$, more preferably 0.5 to 2.0 kgf/cm$^2$. A lower pressure will result in a lowering of polishing rate whereas a higher pressure will adversely affect the uniformity of polished surface.

Preferably, the abrasive tape 2 is fed at a speed of 1.0 to 4.0 mm/sec., more preferably 1.5 to 3.0 mm/sec. Slower feed will allow polishing debris to be carried back, causing flaws whereas quicker feed will sometimes cause the abrasive tape to slip over the stamper surface leaving unpolished spots, eventually resulting in irregular polishing.

Preferably, the stamper 10 is rotated at 100 to 400 r.p.m., more preferably 150 to 300 r.p.m. during polishing operation. Slower rotation will result in a lowering of polishing rate whereas quicker rotation will produce a substantial amount of heat which can induce stresses in the stamper.

Preferably, the tape feed system including pressure roller 4 and abrasive tape 2 is reciprocated radially of the stamper 10 at a rate of 3 to 30 sec./stroke, more preferably 5 to 10 sec./stroke. A reciprocating stroke requiring less than 3 seconds will cause flaws during polishing whereas a reciprocating stroke requiring more than 30 seconds will sometimes result in radial variations in thickness.

The method of the invention is preferably applied to both rough and finish abrasion of the stamper rear surface.

The abrasion rate will vary depending on various parameters associated with the pressure roller, stamper and abrasive tape, but preferably ranges from about 10/100 μm/min. to 1 μm/min. for rough abrasion and from about 2/100 μm/min. to 20/100 μm/min. for finish abrasion. The abrasion depth preferably ranges from about 2.0 to 10.0 μm for rough abrasion and from about 0.5 to 2.0 μm for finish abrasion.

The abrasive tape 2 used herein is not particularly limited. Conventional abrasive tapes having various abrasive grains such as white alumina bound to a plastic base with a binder may be used.

The polishing apparatus is not particularly limited insofar as the pressure roller as defined herein can be incorporated. Polishing can be performed by using any desired commercially available polishing apparatus and controlling the components so as to meet the operational parameters as mentioned above. Examples of the commercially available polishing apparatus include a two head stamper polisher manufactured by Imai Mfg. K.K. and a stamper polisher manufactured by Sansin K.K.

EXAMPLE

Examples of the present invention is given below by way of illustration and not by way of limitation.

Example 1

A stamper was fabricated by forming a photoresist layer on an electroformed nickel film and defining a tracking mother pattern in the photoresist layer. The stamper had a diameter of 148 mm and a thickness of 0.3 mm. The surface pattern consisted of spiral pre-grooves at a track pitch of 1.6 μm and a groove depth of 0.07 to 0.08 μm.

Using a polisher having the arrangement shown in FIG. 1, that is, a stamper polisher manufactured by Sansin K.K., the rear surface of the stamper was polished under the following conditions.

Pressure roller

Rubber layer thickness: 10 mm
Rubber material: urethane rubber
Pressure: 1 kgf/cm$^2$
Roller diameter: 40 mm
Roller length: 50 mm
Reciprocation in stamper radial direction: 6 sec./-stroke Stamper Rotation: 250 r.p.m.

Abrasive tape

The abrasive tapes used were WA 2000 having an average abrasive grain size of about 6 μm and WA 4000 having an average abrasive grain size of about 3 μm, both available from Nihon Micro Coating K.K.

Rough abrasion was performed for 10 minutes at an abrasion rate of 0.5 μm/min. using WA 2000. Finish abrasion was then performed for 10 minutes at an abrasion rate of 0.1 μm/min. using WA 4000.

A plurality of stampers were polished on the rear surface using pressure rollers having different rubber sleeves with a hardness of 70, 80 and 90 degrees as measured according to ASTM D 2240 type A.

Using the resulting stampers, optical disk substrate Nos. 1 to 3 were fabricated by molding polycarbonate resin in an injection molding machine. The optical disk substrates were measured for dynamic axial runout acceleration at a location spaced 55 mm from the substrate center while rotating the substrate at 1,800 r.p.m. Three samples were measured for each of the optical disk substrates. An average of measurements is reported in Table 1 to correspond with the rubber hardness of the pressure rollers used in the production of the stampers from which the optical disk substrates were fabricated.

The dynamic axial runout acceleration is given by the acceleration of an optical pickup during focusing servo operation, which represents the flatness of the surface of the substrate in which tracking grooves are formed. It is desired that the dynamic axial runout acceleration be up to 10 m/sec$^2$. If the dynamic axial runout acceleration at 1,800 r.p.m. is up to 5 m/sec$^2$, then it can be satisfactorily operated at 3,600 r.p.m.

TABLE 1

| Substrate No. | Rubber hardness | Dynamic axial runout acceleration |
|---|---|---|
| 1 (comparison) | 90 degrees | 17.8 m/sec$^2$ |
| 2 | 80 degrees | 9.8 m/sec$^2$ |
| 3 | 70 degrees | 5.0 m/sec$^2$ |

Also, a stamper was polished on the rear surface using a pressure roller having a rubber sleeve with a hardness of lower than 20 degrees. The abrasion rate was below the practically acceptable level.

There has been described a method for polishing at high accuracy the rear surface of a stamper for use in the manufacture of optical disks.

Although some preferred embodiments have been described, many modifications and variations may be made thereto in the light of the above teachings. It is therefore to be understood that within the scope of the appended claims, the invention may be practiced otherwise than as specifically described.

We claim:

1. A method for polishing a rear surface of a stamper for use in the manufacture of optical disks requiring high speed rotation, comprising the step of:

feeding a length of abrasive tape across the stamper in pressure contact with the rear surface of the stamper through a pressure roller while the stamper is rotating, said pressure roller comprising a surface layer formed of a rubber having a hardness of up to 80 degrees as measured according to ASTM D 2240 type A for minimizing vibrations of the pressure roller and stamper caused by a motor for driving the stamper so as to uniformly polish the rear surface of the stamper.

2. The method of claim 1 wherein said surface layer has a radial thickness of at least 5 mm.

3. The method of claim 1 wherein said pressure roller is pressed again the stamper under a pressure of 0.5 to 3.0 kgf/cm2.

4. The method of claim 1 wherein the abrasive tape is fed at a speed of 1.0 to 4.0 mm/sec.

5. The method of claim 1 wherein the stamper is rotated at 100 to 400 r.p.m.

* * * * *